US010654619B2

(12) United States Patent
Teper et al.

(10) Patent No.: US 10,654,619 B2
(45) Date of Patent: May 19, 2020

(54) FLUID BOTTLE WITH EXTERNAL ACCESSORIES

(71) Applicant: Hydration Junkie, Pleasant Hill, CA (US)

(72) Inventors: Felix Teper, Pleasant Hill, CA (US); Ruslan Torban, Burlingame, CA (US)

(73) Assignee: Hydration Junkie, Pleasant Hill, CA (US)

( * ) Notice: Subject to any disclaimer, the term of this patent is extended or adjusted under 35 U.S.C. 154(b) by 0 days.

(21) Appl. No.: 16/125,634

(22) Filed: Sep. 7, 2018

(65) Prior Publication Data

US 2019/0075914 A1 Mar. 14, 2019

Related U.S. Application Data

(60) Provisional application No. 62/556,227, filed on Sep. 8, 2017.

(51) Int. Cl.

| | |
|---|---|
| ***A45F 3/18*** | (2006.01) |
| ***B65D 1/02*** | (2006.01) |
| ***B65D 23/10*** | (2006.01) |
| ***B65D 23/12*** | (2006.01) |
| ***B65D 51/18*** | (2006.01) |
| *A45F 3/00* | (2006.01) |
| *A45F 5/10* | (2006.01) |

(52) U.S. Cl.

CPC ..... *B65D 23/12* (2013.01); *A45F 3/18* (2013.01); *B65D 1/0246* (2013.01); *B65D 23/10* (2013.01); *B65D 23/102* (2013.01); *B65D 23/108* (2013.01); *B65D 51/18* (2013.01); *A45F 2003/003* (2013.01); *A45F 2005/1006* (2013.01); *A45F 2200/055* (2013.01); *A45F 2200/0516* (2013.01); *A45F 2200/0558* (2013.01); *B65D 2313/04* (2013.01)

(58) Field of Classification Search

CPC ..... A45F 3/18; A45F 2003/003; A45F 2200/0516; A45F 2200/0558; B65D 1/0246; B65D 23/102; B65D 23/108; B65D 23/12; B65D 23/14; B65D 23/16; B65D 51/18; B65D 2313/04

USPC ..... 206/217, 37.8; 215/390, 397, 306, 386, 215/396; 220/758, 773

See application file for complete search history.

(56) References Cited

U.S. PATENT DOCUMENTS

| | | | | |
|---|---|---|---|---|
| 3,307,752 A * | 3/1967 | Anderson | B65D 23/108 222/465.1 |
| 9,981,768 B1 * | 5/2018 | Palmer | B65D 1/0207 |
| 2005/0035084 A1 * | 2/2005 | Simpson, Jr. | B65D 1/0223 215/396 |
| 2010/0237098 A1 * | 9/2010 | Kaufman | B65D 83/206 222/113 |
| 2013/0001122 A1 * | 1/2013 | Nowzari | B65D 23/085 206/459.5 |

(Continued)

FOREIGN PATENT DOCUMENTS

WO WO-2016081387 A1 * 5/2016 ..... A45F 3/16

*Primary Examiner* — Andrew D Perreault
(74) *Attorney, Agent, or Firm* — Inskeep IP Group, Inc.

(57) ABSTRACT

A fluid bottle is disclosed, having a phone retention portion, a key retentions portion, a card retention portion, and a cap and handle assembly. The bottle allows a user to better organize personal items, such as a phone, keys, credit cards or money, and/or headphones.

16 Claims, 15 Drawing Sheets

(56) References Cited

U.S. PATENT DOCUMENTS

| | | | | |
|---|---|---|---|---|
| 2013/0075281 | A1* | 3/2013 | Diebel | G06F 1/1626<br>206/45.24 |
| 2014/0374418 | A1* | 12/2014 | Ouellette | B65D 51/18<br>220/254.8 |
| 2017/0245624 | A1* | 8/2017 | Neves | A45F 3/16 |
| 2018/0244423 | A1* | 8/2018 | Palmer | B65D 1/0207 |

* cited by examiner

FLUID BOTTLE WITH EXTERNAL ACCESSORIES

RELATED APPLICATIONS

This application claims priority to U.S. Provisional Application Ser. No. 62/556,227 filed Sep. 8, 2017 entitled Hydration Junkie, which is hereby incorporated herein by reference in its entirety.

BACKGROUND OF THE INVENTION

Experts generally agree on the need to stay hydrated before, during, and after exercise. For this reason, it has become popular to bring a water bottle, or similar fluid container, to the gym or other exercise area. While water bottles are typically convenient and easy to carry along, it can be challenging to also take along other person items to a workout, such as keys, cell phone, and credit cards/cash. Backpacks or other bags can be used but are typically relatively large in a gym environment and can therefore present a tripping hazard to the user and those around them. Similarly, in an outdoor workout environment, a user may only want to carry a few items with them (keys, credit cards, phone) without the bulk of a large bag or purse. While users sometimes have pockets in their workout clothes, large cell phones, keys, and credit cards are bulky and distracting to the wearer. Further, vigorous exercise can lead to these items falling out from the pockets.

Additionally, some workouts may include the use of a phone for tracking time or viewing instructional videos. However, without also carrying around a separate phone stand or similar support, it can be difficult to prop up and angle a phone in a desirable direction for working out.

Therefore, what is needed is a better method of organizing a user's water bottle and other personal items, especially in a gym environment, while also providing a convenient support for viewing a cell phone during a workout.

SUMMARY OF THE INVENTION

In one embodiment, a fluid bottle (or jug or fluid container) is disclosed, having a phone retention portion, a key retentions portion, a card retention portion, and a cap and handle assembly. The bottle allows a user to better organize personal items, such as a phone, keys, credit cards or money, and/or headphones.

In one embodiment, the bottle comprises a plurality of walls forming an interior cavity configured to hold fluid, and a top opening into the interior cavity. A cap assembly is selectively engageable (e.g., via threads) over the top opening. A phone retention mechanism (e.g., a magnet assembly that attracts a steel plate attached to a phone) is fixed on an angled portion of one of the plurality of walls for selectively holding and releasing a user's phone.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
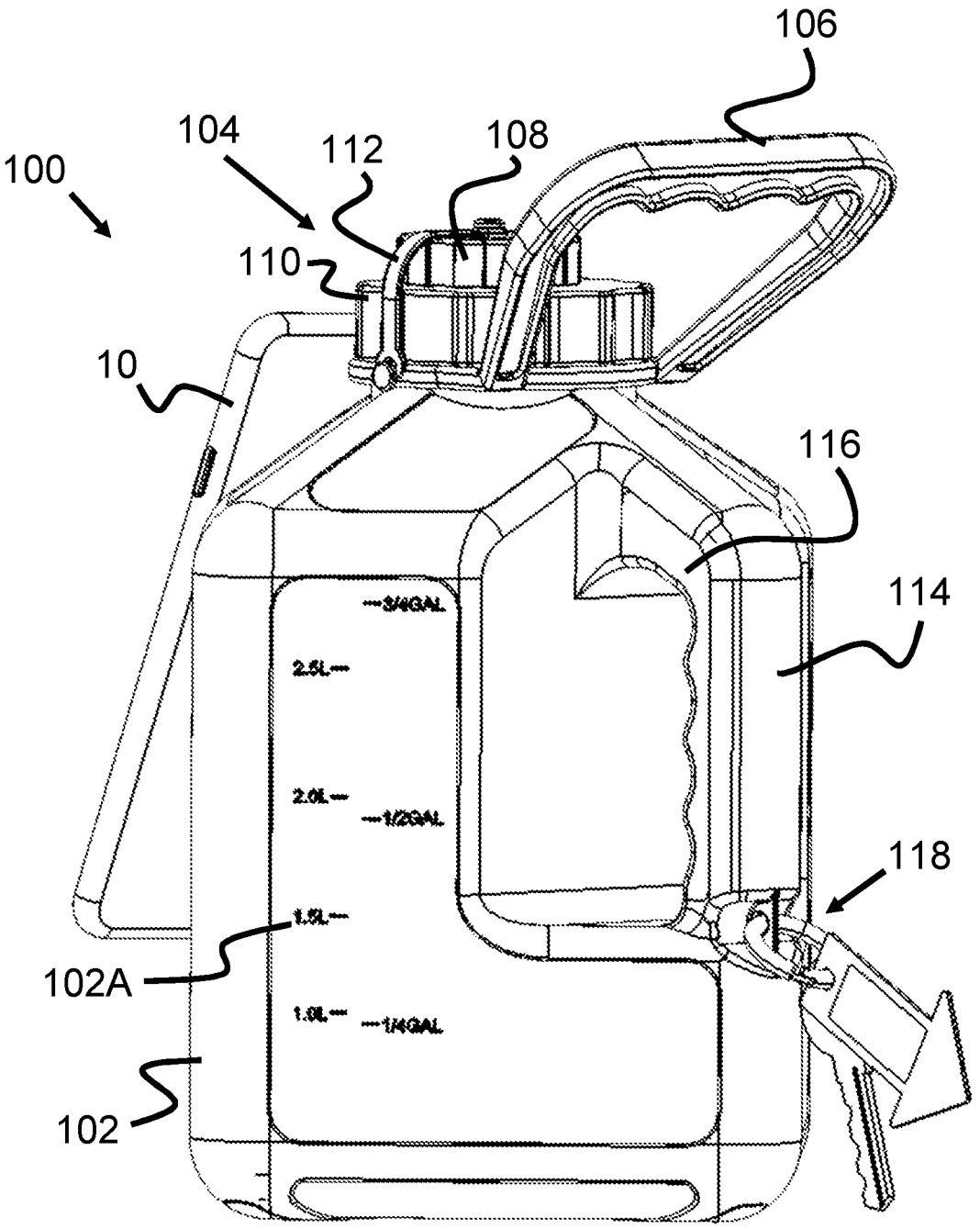
FIGS. 1, 2, 3, 4, 5, and 6 illustrate various perspective views of a fluid bottle according to the present invention.
Figure 2:
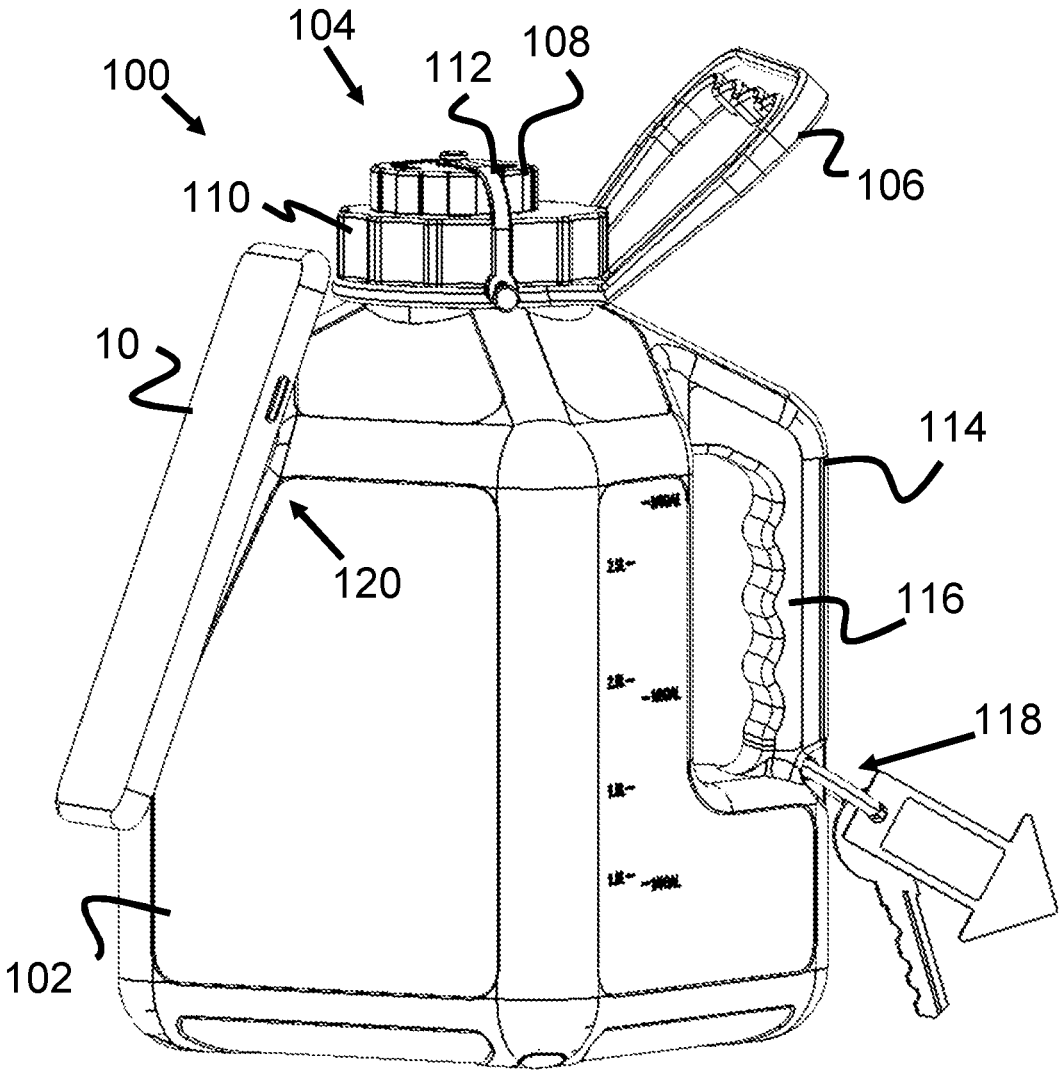

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIGS. 1-6 illustrate various views of a fluid bottle 100 that has various features for retaining and organizing common user items. For example, the bottle 100 may include a phone retention area 120, a key retention area 118, and a card/money retention portion 122. Hence, a user is able to bring various items with them to a workout session without the use of a bulky bag, overstuffed pockets, or the chance of these items being stepped on (e.g., either in a bag or after falling out from a pocket). While the term fluid bottle is used in this specification, it should be understood that this may also be referred to as a jug of fluid container.

The body 102 of the bottle 100 has a generally rectangular shape with rounded corners and angled top surfaces. One corner of the body 102 is partially "cut away," inwardly molded, or removed to form a handle 114 that is connected at its top and bottom. In one embodiment, the interior of the bottle 100 can contain about 3 liters of fluid (0.79 gallons). However, other volumes are also possible, such as 2 liters, 0.5 gallon, 1 gallon, and 1.5 gallon.

Figure 14:
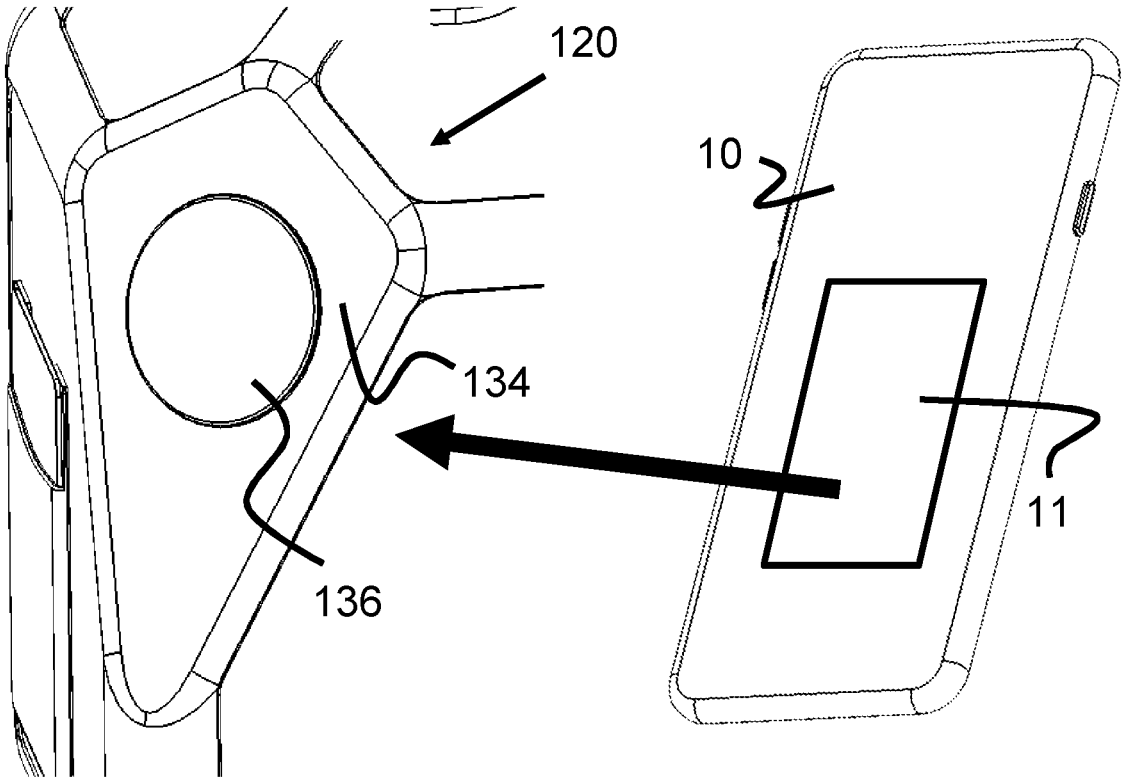
FIGS. 14, 15, and 16 illustrate various views of a magnet assembly for retaining a phone, according to the present invention.
Figure 15:
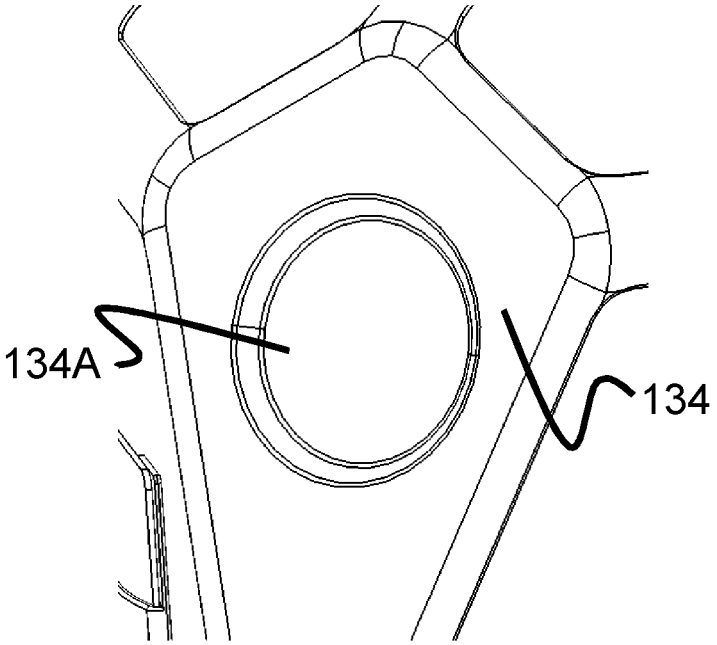
Figure 16:
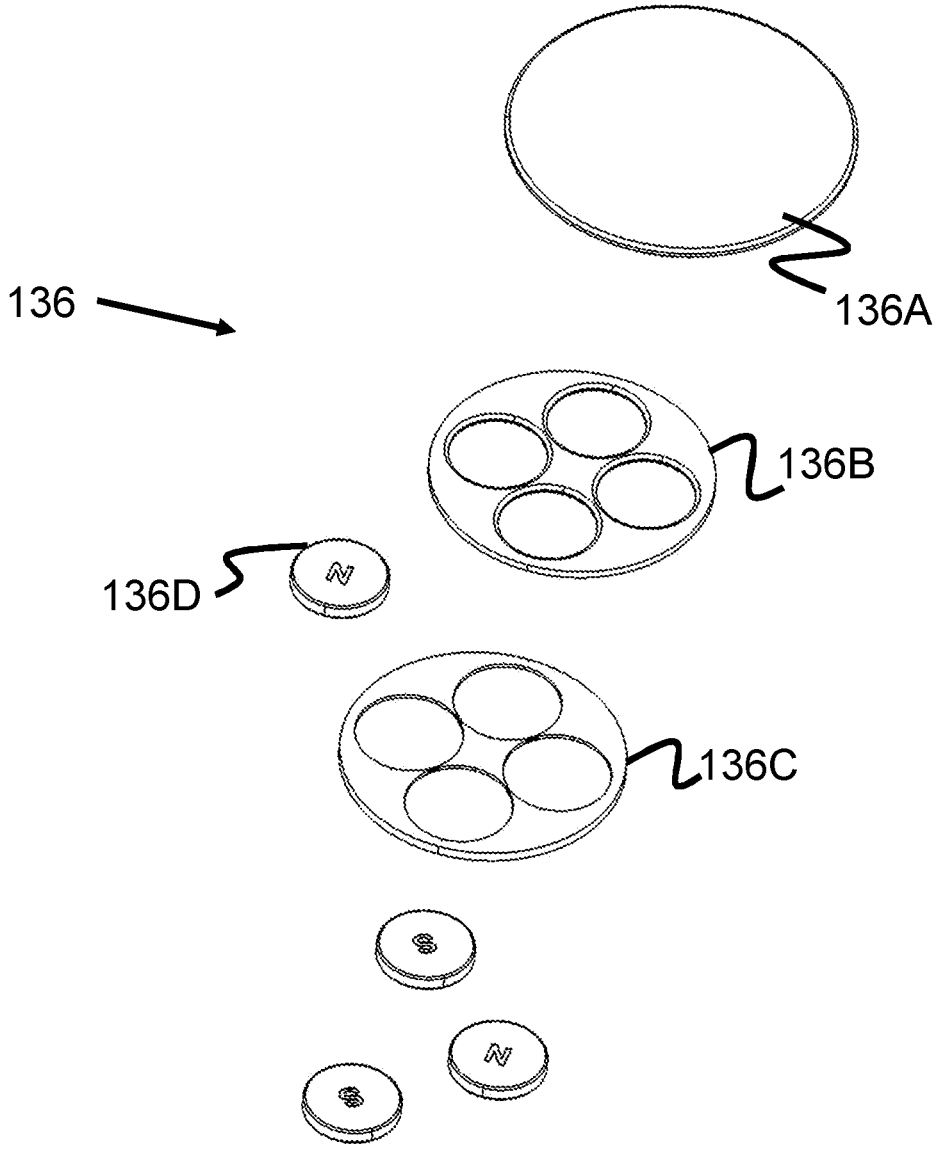

In one aspect of the present invention, a cell phone 10 can be releasably secured to the phone retention area 120, which can be seen best in FIGS. 14-16. The phone retention area 120 includes a surface 134 that is generally triangular or narrowing in the downward direction and that is positioned at an angle between 0 and 90 degrees relative to the verticality of the adjacent walls of the bottle 100. In one specific example, the surface 134 is positioned at about 45 degrees relative to the adjacent walls. In one embodiment, the phone 10 is retained in place on the surface 134 via a magnet assembly 136. The magnet assembly 136 can be generally circular (though other shapes are possible) and is sized to fit or "snap" into a mating depression 134A in the surface 134. As best seen in FIG. 16, the magnet assembly 136 may include a top cover 136A, a middle body portion 136B with apertures to retain the magnets 136D (e.g., 4 circular magnets 136D), and a bottom portion 136C with recessions to further retain the magnets 136D. Together, components 136A, 136B, and 136C create a housing for the magnets 136D, thereby allowing the magnet assembly 136 to produce a magnetic field to retain a phone. It should be noted that many phones are composed primarily of aluminum or plastic and therefore require that a ferrous metal or magnet-containing plate be attached to the phone 10 in order to take advantage of the magnet assembly 136. In one embodiment seen in FIG. 14, a steel plate 11 (or other ferrous metal) is provided, having an adhesive on one side that can be used to adhere to a user's phone 10 and thereby allow for interaction with the magnet assembly 136. Alternately, a phone case containing the steel plate 11 can be attached to the phone 10 to allow of interaction with the magnet assembly 136. In another embodiment, a metal/steal plate can be fixed on the bottle 100 and a magnet can be fixed to the phone via a phone case.

In addition to the magnet assembly 136, or as an alternative to the magnet assembly, other retention mechanisms can be used. For example, the surface 134 may include a Velcro strap that can be tightened over the phone. In another example, the surface 134 may have a depression in the shape of the phone 10 and which the phone may fit into. In another example, the surface 134 may include raised ridges that engage the edges of the phone 10. In yet another example, the surface 134 may include a clear silicone pocket that the phone 10 can be easily placed into and pulled out of.

Figure 4:
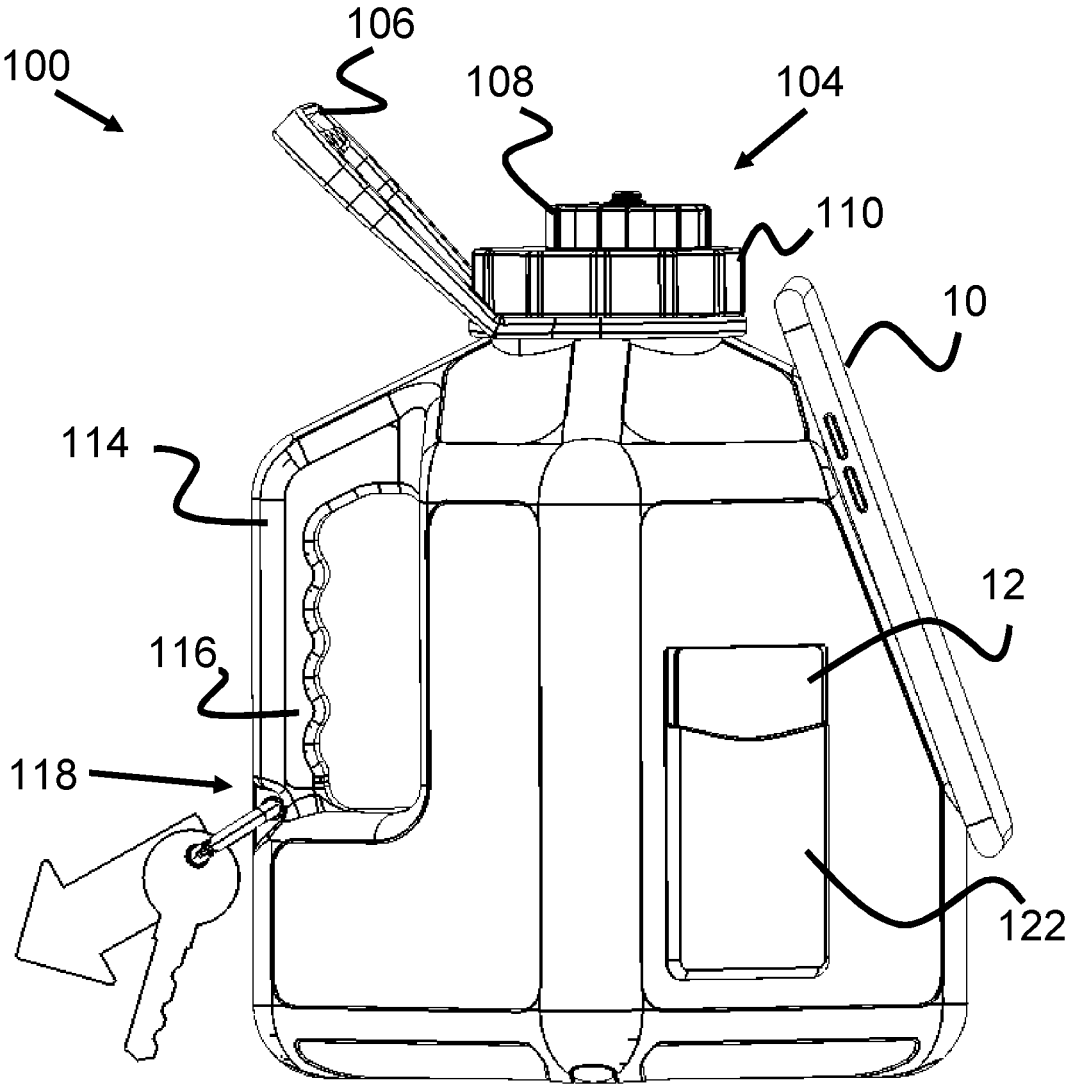
Figure 5:
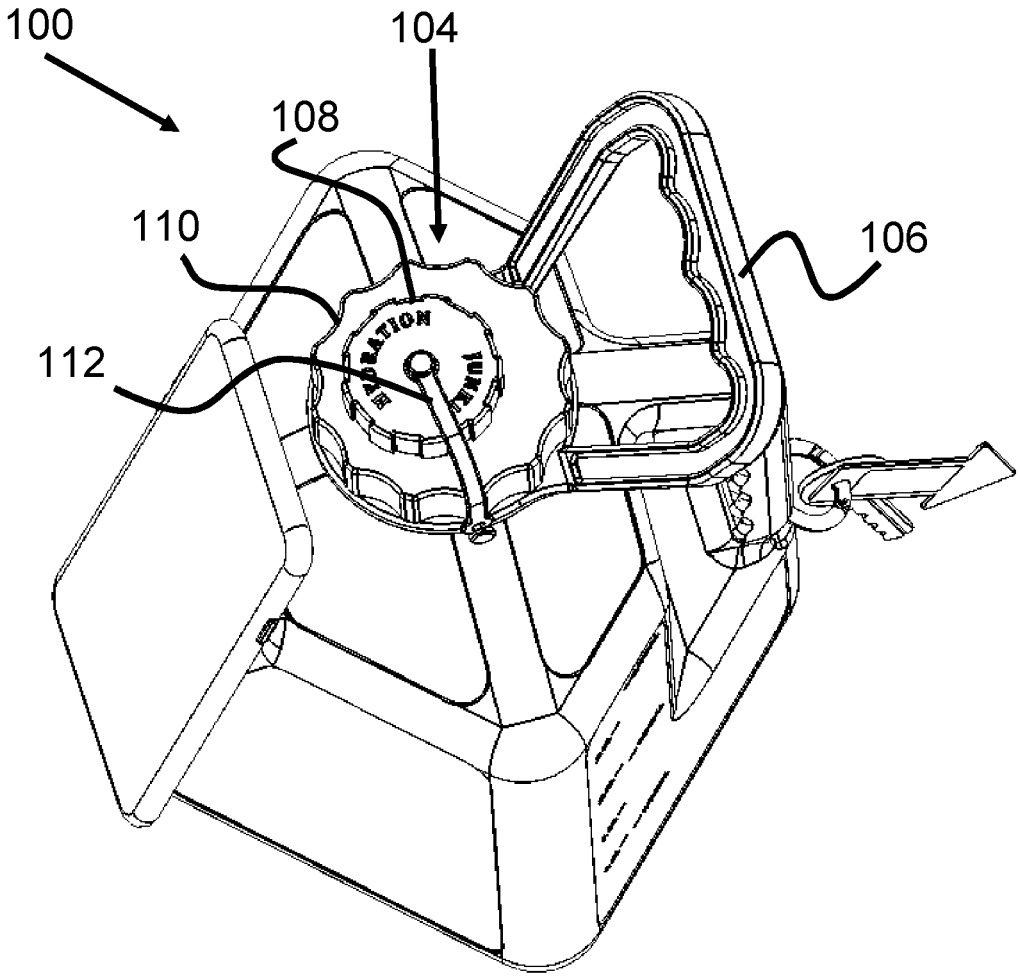
Figure 6:
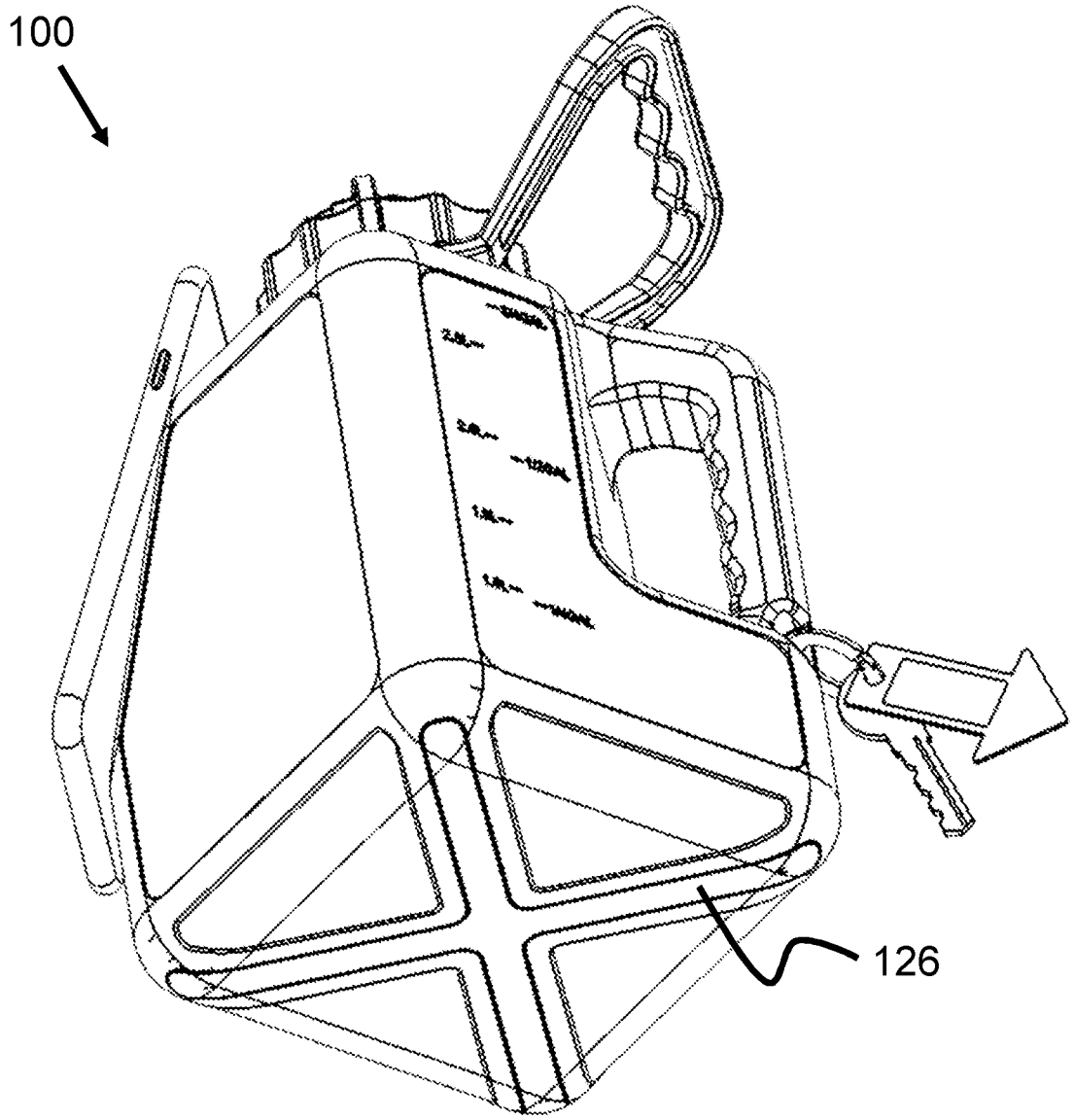
Figure 7:
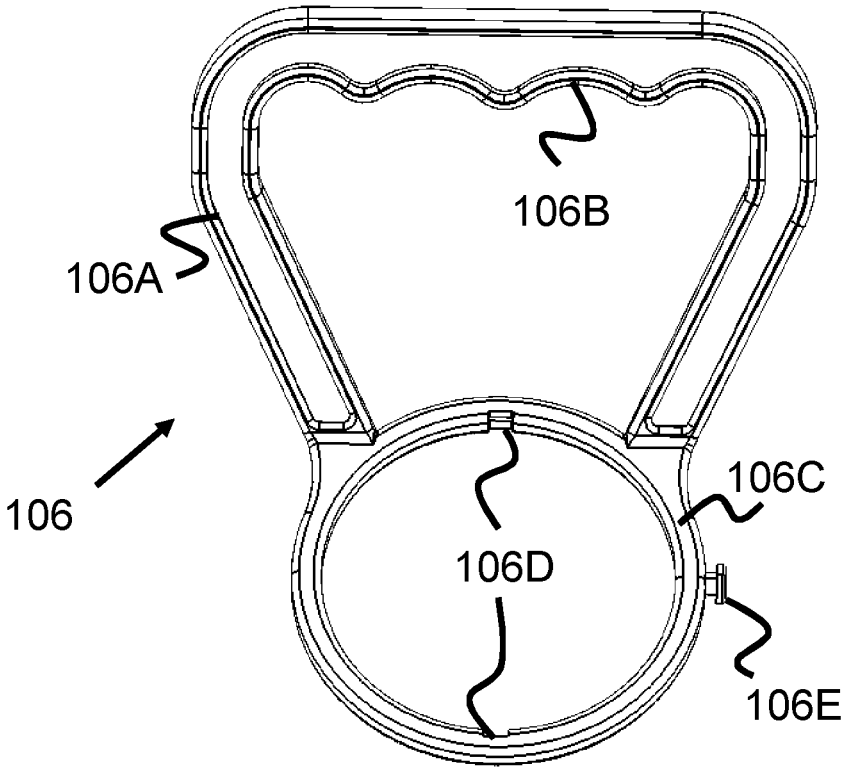
FIGS. 7-9 illustrate various views of an angled handle according to the present invention.
Figure 8:
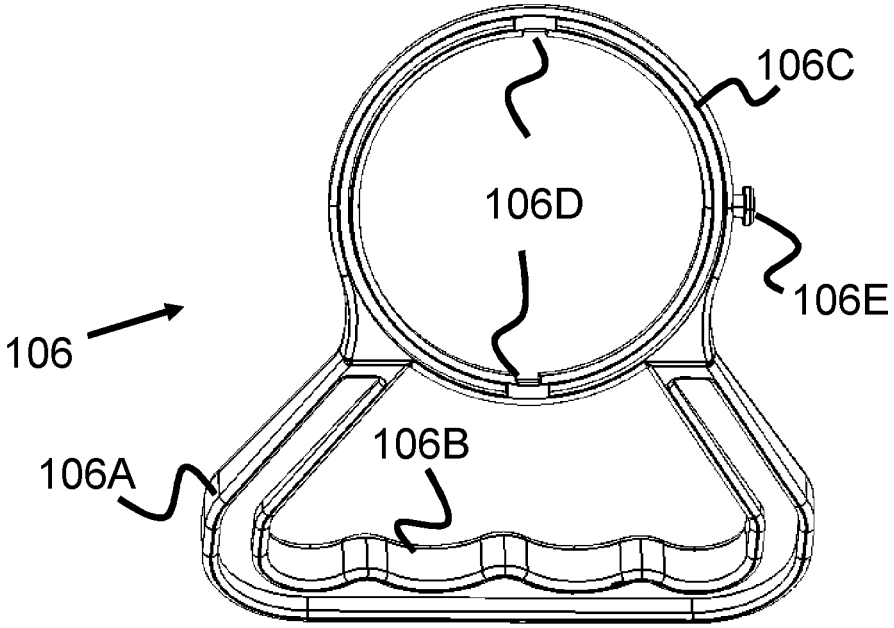
Figure 21:
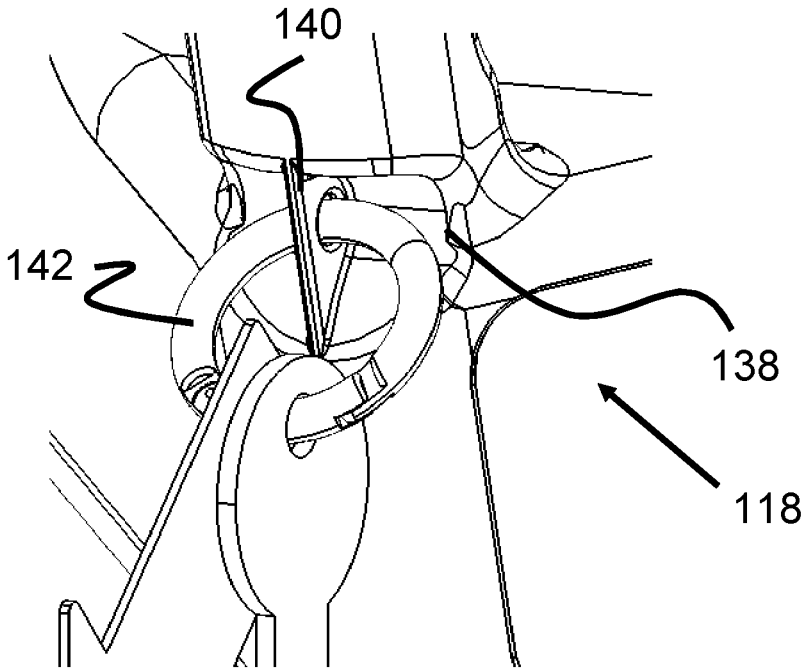
FIGS. 21 and 22 illustrate a key retention portion according to the present invention.
Figure 22:
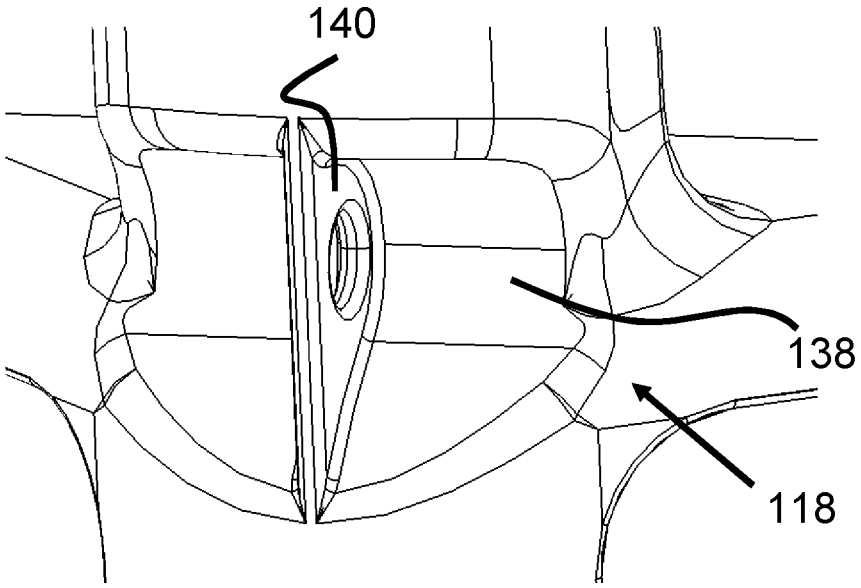

The bottle 100 also preferably includes a key retention area 118, as seen best in FIGS. 4, 21, and 22, for retaining keys and similar items. In one embodiment, the key retention area 118 comprises a recessed or notched area 138 positioned at the outer base of handle 114. The notched area 138 includes a vertical fin or wall 140 having an aperture therethrough that is sized to accept a key ring or karabiner 142 onto which keys can be placed. The wall 140 can be composed of and molded with the same material as the bottle's body 102 (e.g., a polymer such as BPA free Tritan material), can be composed of a metal, or can be composed of polymer with metal reinforcements (e.g., a metal ring embedded around the circumference of the aperture). In one example, the lower surface of the notched area 138 can be angled between 0 and 90 degrees (e.g., 45 degrees) to cause the key ring 142 to also extend outward at an angle.

Figure 3:
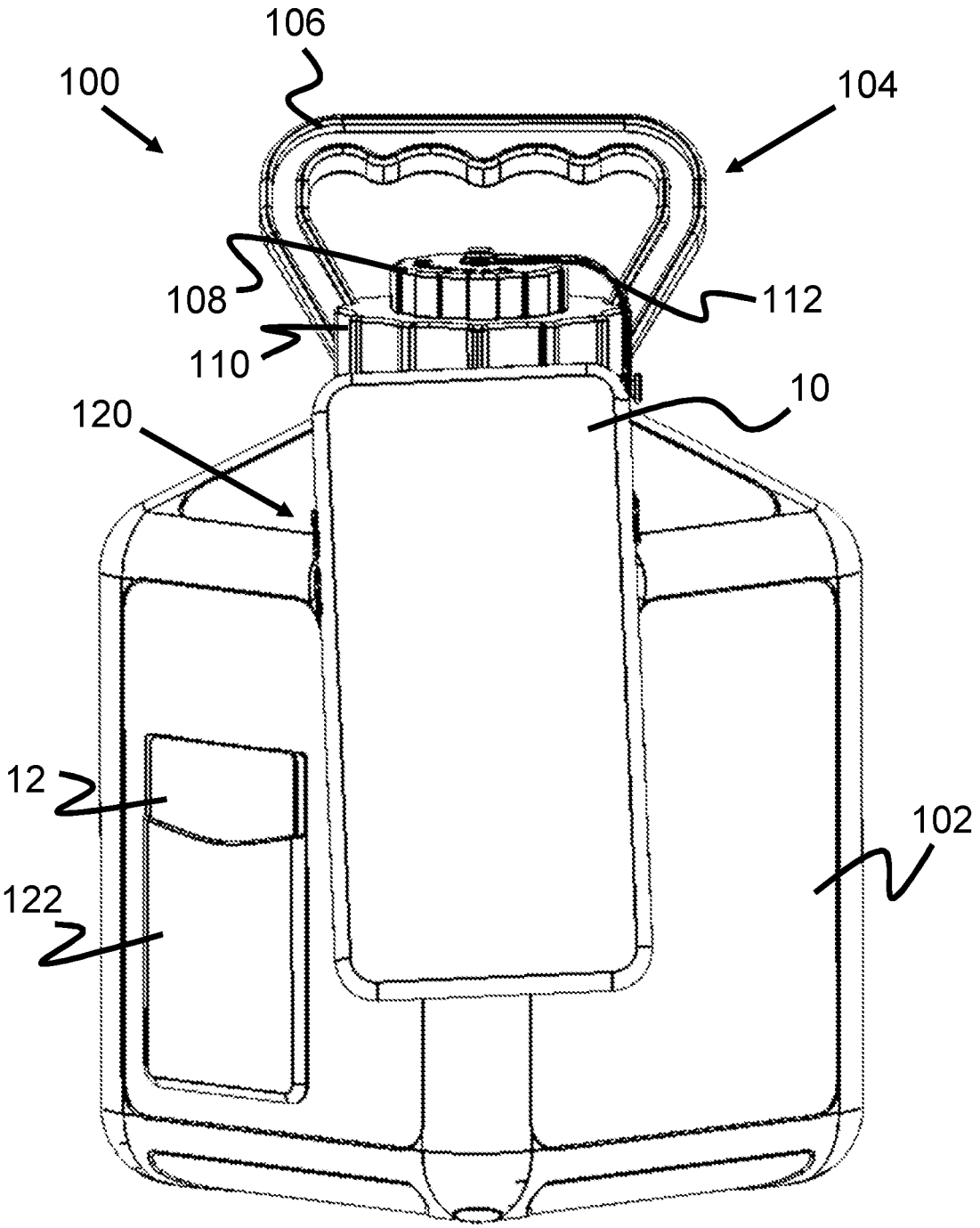
Figure 17:
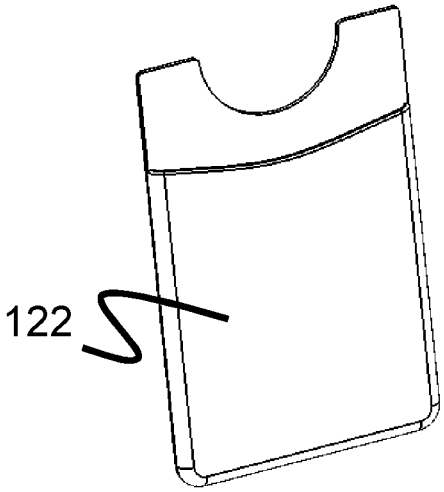
FIG. 17 illustrates a card holder according to the present invention.

The card/money retention area 122 can be seen best in FIGS. 3 and 17, which may comprise a pocket sized to accept credit cards, money, and similarly sized items. The pocket can be composed of a flexible material, such as silicone, or can be composed of a rigid polymer material. In one embodiment, the pocket is sized somewhat larger than a credit card to allow a user to place their headphone inside. Alternately, the bottle 100 may include an attached Velcro loop that can be selectively opened and closed around a set of headphones (e.g., wired headphones that are coiled or a portion of wireless headphones).

Figure 9:
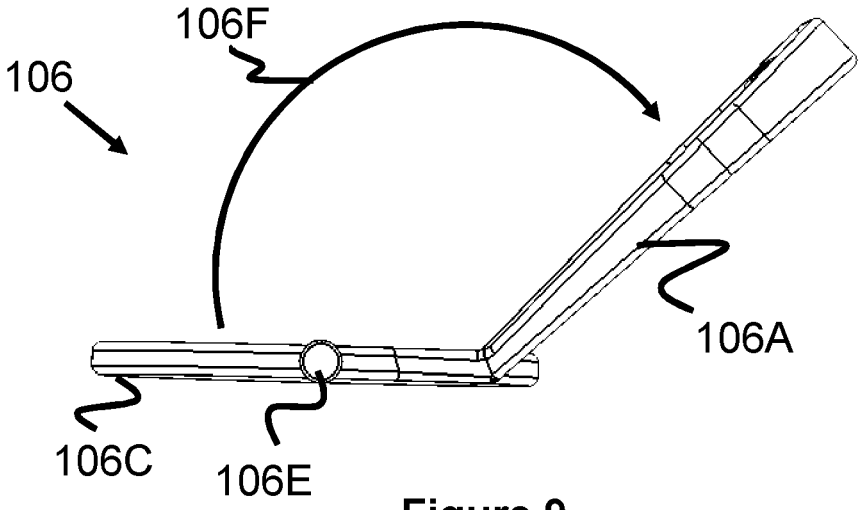

The bottle 100 may also include a cap and handle assembly 104 to facilitate filling the bottle 100 with ice and fluid, easily drinking from the bottle 100, and carrying the bottle 100. First, the cap and handle assembly 120 includes an angled handle 106, as seen best in FIGS. 1-9, that includes a handle loop portion 106A that is connected to a circular portion 106C. The circular portion 106C (which can be a variety of different shapes) preferably has an inner diameter that is slightly larger than the opening 130 of the bottle 100 (FIG. 10), which allows it to fit around the opening 130. To prevent the circular portion 106C from rotating around the opening 130, the circular portion 106C has two recesses or notches 106D that are sized to engage and mate with two horizontally-extending portions 130B. The handle loop portion 106A preferably includes a plurality of finger grooves 106B (e.g., 4) along its top inner surface, and as seen best in FIG. 9, extends from the circular portion 106C at an angle 106F between 0 and 90 degrees (e.g., about 45 degrees).

Figure 10:
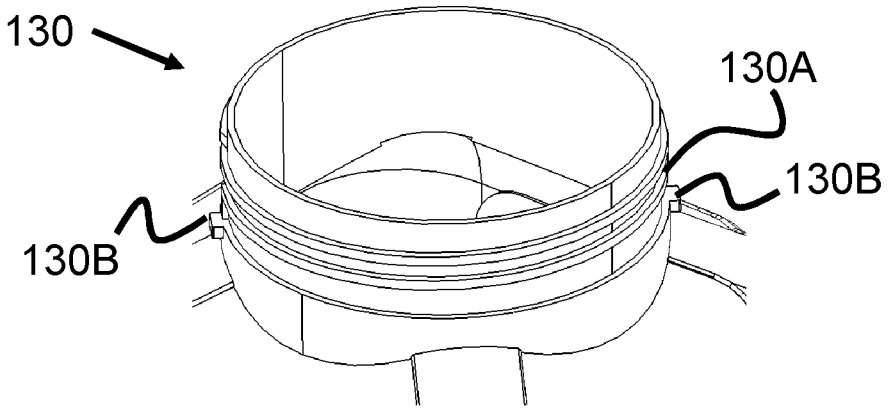
FIG. 10 illustrates a top opening of a bottle according to the present invention.
Figure 11:
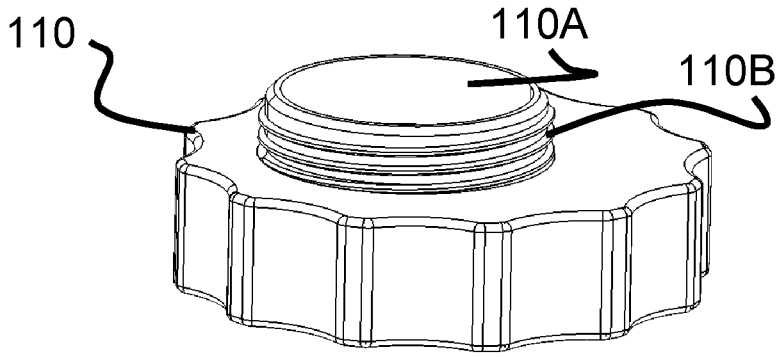
FIGS. 11 and 12 illustrate various views of a large cap of a bottle according to the present invention.
Figure 12:
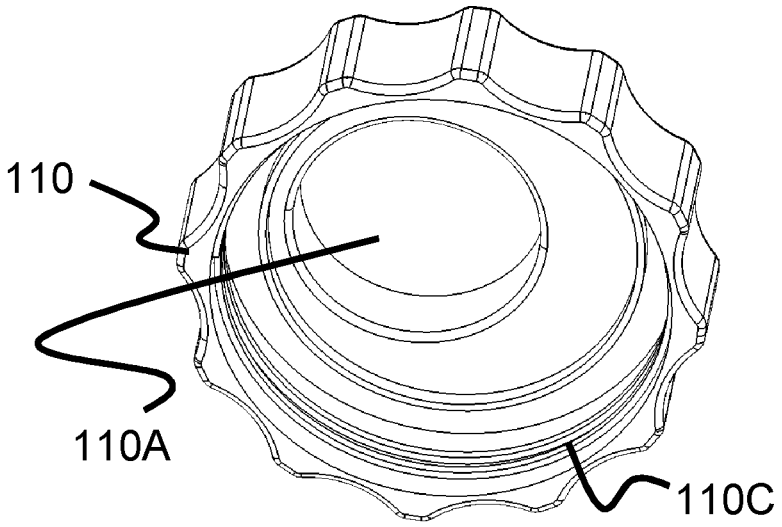
Figure 13:
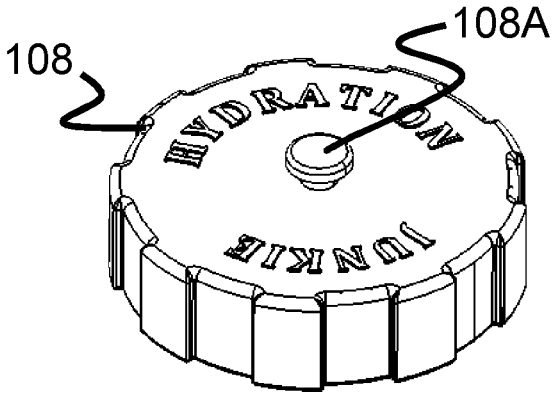
FIG. 13 illustrates a small cap of a bottle according to the present invention.

The cap and handle assembly 120 further comprises a large cap 110, seen best in FIGS. 10 and 11, having an inner thread 110C that mates/engages with the thread 130A of the opening 130. When engaged with the thread 130A, the large cap 110 helps maintain the vertical position of the circular portion 106C of the angled handle 106, preventing the recesses 106D from becoming disengaged with the horizontally extending portions 1308. The top of the large cap 110 further includes a raised opening 110A have exterior threads that engage the inner threads of a small cap 108 (FIG. 13). In this respect, opening the large cap 110 allows the bottle 100 to be easily filled with fluid and ice, while the small cap 108 provides for a smaller opening for a user to drink from.

The cap and handle assembly 104 is further retained to each other via a flexible strap 112 (e.g., silicone) that has apertures on each end that connect over a vertical post 108A on the small cap 108 and to a horizontal post 106E on the angled handle 106. Preferably, the posts 108A, 106E have enlarged distal ends to help retain the strap 112.

Figure 18:
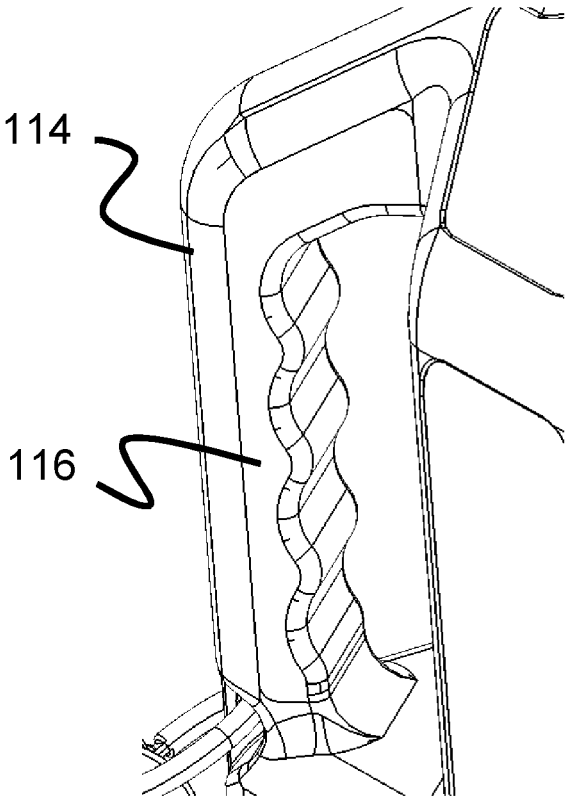
FIGS. 18, 19, and 20 illustrate a side handle according to the present invention.
Figure 19:
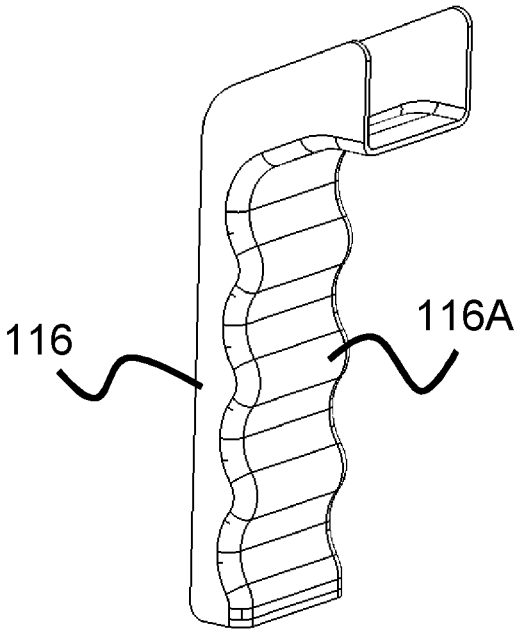
Figure 20:
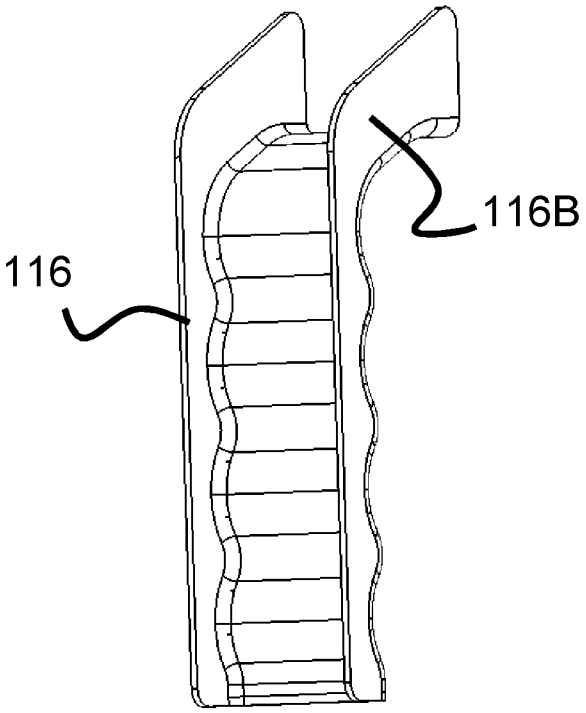

In order to help increase strength and/or provide grip-enhancing texture, the side handle 114 can optionally include an overlay handle portion 116 as seen in FIGS. 18-20. The overlay handle portion can have similar dimensions to the inner portion of the handle 114, as well as sidewalls that help engage the handle 114 (adhesives can also be used). Preferably, a rigid material, such as PVC is used to increase the strength of the handle, especially when full of fluid. A plurality of textured finger grooves 116A may be composed of a texture and/or material that enhances a user's grip. However, this texture and finger grooves can also be molded as a unitary portion of the bottle 100.

Figure 23:
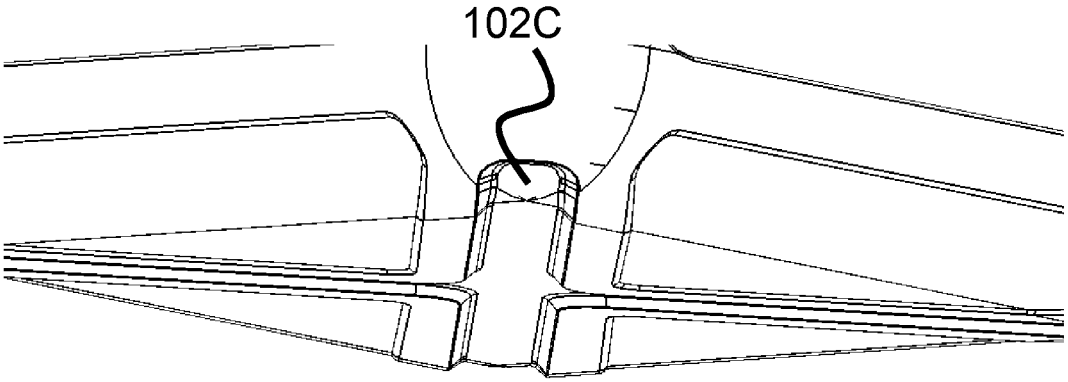
FIGS. 23, 24, and 25 illustrate a bottom support for a bottle according to a present invention.
Figure 24:
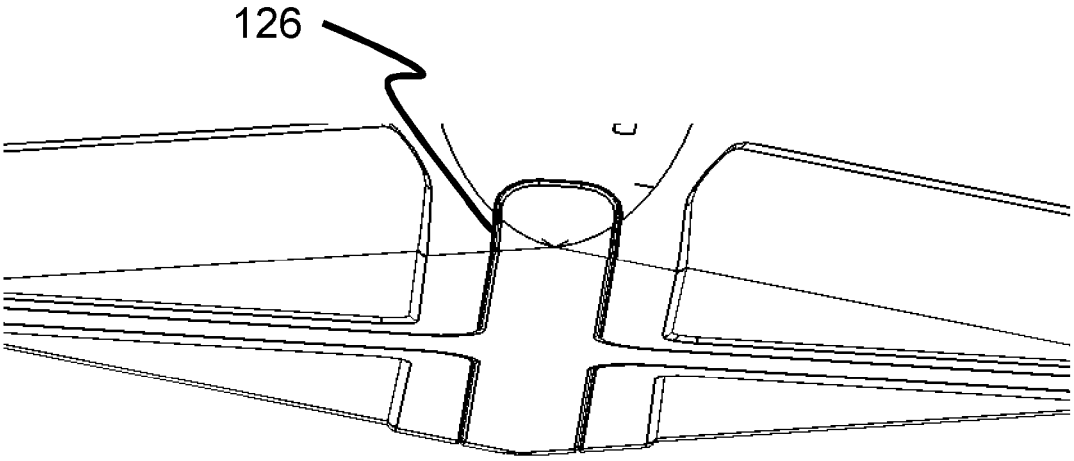
Figure 25:
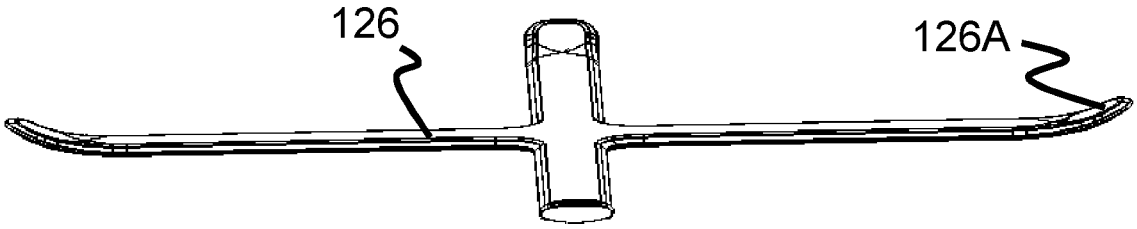

As seen best in FIGS. 23-25, the bottom surface of the bottle 100 may optionally include a recessed cross or X shape 102C into which reinforcement member 126 mates with and is fixed to (e.g., via adhesives). The reinforcement member 126 is preferably composed of a rigid material (e.g., PVC) to provide enhanced support to the bottle 100 and can be contoured to maintain a uniform bottom profile, such as with the upward contours 126A. Optionally, the bottom surface of the reinforcement member 126 can be configured with a textured or friction-generating coating to help prevent sliding or slippage of the bottle 100 during use. Alternately, this textured cross shape 102C can be molded as a unitary portion of the bottle 100 instead of a separate component.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A bottle for containing fluids; comprising:

a bottle body having a plurality of walls forming an interior cavity configured to hold fluid, and a top opening into said interior cavity; said plurality of walls comprising a first wall, a second wall, a third wall, and a fourth wall, all of which are positioned perpendicular to a bottom surface of said bottle body;

a cap assembly that is selectively engageable with said top opening;

a portable electronic device retention surface that is:

positioned between an intersection of said first wall and said second wall;

positioned at about 45 degrees relative to said first wall and said second wall;

a first elongated side and a second elongated side oriented downwards, towards each other to form a triangular shape;

a third shortened side and a fourth shortened side oriented upwards, towards each other to form an upper peak, the third shortened side and the fourth shortened side being smaller than the first elongated side and the second elongated side;

a portable electronic device retention mechanism fixed on said portable electronic device surface and configured to engage and release a portable electronic device;

a vertically oriented handle formed by a recessed passage into said third wall and said fourth wall;

a recessed notch located near a bottom of said vertically oriented handle;

a fin fixed vertically within said notch; said fin having an aperture creating a passage therethrough.

2. The bottle of claim 1, wherein said portable electronic device retention mechanism comprises one or more magnets.

3. The bottle of claim 1, wherein said portable electronic device retention mechanism comprises a magnet housing containing said one or more magnets, and wherein said magnet housing is fixed within a depression of said one of said plurality of walls that said portable electronic device retention mechanism is fixed.

4. The bottle of claim 1, further comprising a ferrous metal plate with adhesives on one side, and being configured to adhere to a phone.

5. The bottle of claim 1, wherein said recessed notch is located at a base of said vertically oriented handle.

6. The bottle of claim 1, further comprising a pocket disposed on one of said plurality of walls; said pocket being composed of flexible material.

7. The bottle of claim 1, further comprising a top handle that is removably attachable around said top opening, said top handle having a handle loop portion that is angled between 0 and 90 degrees relative to said top opening.

8. The bottle of claim 7, wherein an exterior of said opening and an interior of said top handle have mating surfaces that engage each other to prevent said handle from rotating relative to said bottle.

9. The bottle of claim 1, wherein said cap assembly comprises a first cap that engages a thread around said opening; and a second cap that engages a thread around a cap opening on said first cap.

10. The bottle of claim 9, further comprising a top handle that is removably attachable around said top opening, said top handle having a handle loop portion that is angled between 0 and 90 degrees relative to said top opening; and wherein said second cap is attached to said top handle via a flexible strap member.

11. A fluid jug for containing fluids; comprising:

a jug body having a plurality of walls forming an interior cavity configured to hold fluid, a top opening into said interior cavity, and a first handle on a side of said jug body; said jug body having a plurality of walls comprising a first wall, a second wall, a third wall, and a fourth wall, all of which are positioned perpendicular to a bottom surface of said bottle body;

a cap assembly that is selectively engageable with threading around said top opening;

a portable electronic device retention surface that is:

positioned between an intersection of said first wall and said second wall;

positioned at about 45 degrees relative to said first wall and said second wall;

a first elongated side and a second elongated side oriented downwards, towards each other to form a triangular shape;

a third shortened side and a fourth shortened side oriented upwards, towards each other to form an upper peak, the third shortened side and the fourth shortened side being smaller than the first elongated side and the second elongated side;

at least one magnet fixed on said portable electronic device retention surface and being configured to retain a cellular phone.

12. The fluid jug of claim 11, wherein said at least one magnet is disposed in a magnet housing and said magnet housing is disposed in a depression on said portable electronic device retention surface.

13. The fluid jug of claim 12, further comprising a second handle connected around said top opening and having a handle loop portion fixed at an angle between 0 and 90 degrees relative to said top opening.

14. The fluid jug of claim 13, further comprising a key ring positioned through an aperture located in a recessed portion of one of said plurality of walls.

15. The fluid jug of claim 14, further comprising a bottom surface of said fluid jug forming a cross shape.

16. The fluid jug of claim 13, wherein said handle loop portion is fixed at an angle of about 45 degrees.

* * * * *